United States Patent [19]

Farnworth et al.

[11] 4,230,386

[45] Oct. 28, 1980

[54] SELF LOCKING SAFETY SOCKET

[76] Inventors: Ivan A. Farnworth, 441 S. State; Ivan R. Farnworth, 946 S. 500 East, both of Orem, Utah 84057

[21] Appl. No.: 2,942

[22] Filed: Jan. 12, 1979

[51] Int. Cl.[3] ..... H01R 13/44

[52] U.S. Cl. ..... 339/42

[58] Field of Search ..... 339/40, 42, 111

[56] References Cited

U.S. PATENT DOCUMENTS 4,136,919 1/1979 Howard et al. ..... 339/91 R

FOREIGN PATENT DOCUMENTS 2008420 9/1971 Fed. Rep. of Germany ..... 339/111

2251930 6/1975 France ..... 339/111

*Primary Examiner*—Joseph H. McGlynn

*Attorney, Agent, or Firm*—Criddle & Western

[57] ABSTRACT

A safety socket assembly comprising a non-conductive housing containing a pair of prong receptacles having conductive walls defining a prong slot adapted to receive the prongs of an electric plug, said walls having apertures therein adapted to receive locking means. A pair of corresponding terminals are positioned away from said prong receptacles. A spring loaded displaceable peg is situated between said prong receptacles having attached thereto a pair of flexible conductive contacts located adjacent the prong receptacles which have a forward locking head adapted to fit into the apertures in the receptacle walls when the peg is in a forward position and a tail portion adapted to contact the electrical terminals when brought into alignment therewith as the result of the spring loaded peg being rearwardly displaced. The prong receptacles, flexible contacts and electrical terminals are positioned such that when the peg is in a forward position the flexible contacts are engaged with the prong receptacles only and lock the peg in a forward position but, when the peg is depressed, the flexible contacts engage both the prong receptacles and corresponding electrical terminals.

10 Claims, 6 Drawing Figures

SELF LOCKING SAFETY SOCKET

BACKGROUND OF THE INVENTION

This invention relates to a safety electrical socket of the wall outlet type. More specifically, this invention relates to a safety electrical socket which can only be energized by depression of a locked peg situated between the receptacles of the socket wherein the peg can only be unlocked by inserting the prongs of a plug into both of the prong receptacles of the socket.

The numerous hazards presented by conventional electrical sockets are well known and documented. Many accidents and fatalities occur as a result of children inserting electricity conducting objects into the prong holes of the socket. Various safety sockets have been devised to rectify these problems. Some require additional pieces of equipment to be added to a conventional wall outlet as shown by U.S. Pat. No. 3,942,856. Others require a degree of manual dexterity or manipulation to energize a socket such as the rotational displacement sockets shown in U.S. Pat. Nos. 3,668,607 and 4,037,901.

OBJECTS AND BRIEF DESCRIPTION OF THE INVENTION

It is an object of the present invention to provide a safety electrical socket which can be energized simply by inserting an electrical plug therein.

It is also an object of this invention to provide a safety socket that can only be energized by depressing and holding in position a displaceable electrical contacting means which means can only be depressed when locking means extending into both prong slots of a socket are released by prongs of an electrical plug or similar objects being inserted into both prong slots of the socket.

Another object of this invention is to provide a safety electrical socket wherein locked displaceable electrical contacting means are positioned in the socket between the prong holes such that an electrical plug being inserted into the socket can simultaneously unlock and depress the locked displaceable electrical contacting means and energize the socket.

A still further object of this invention is to provide a safety electrical socket wherein, without the aid of a plug, the manual dexterity required to energize the socket is beyond that possessed by most small children.

These and other objects may be accomplished by means of an electrical socket comprising a non-conductive housing into which are positioned (1) parallel conductive metal prong receptacles adapted to receive the prongs of an electrical plug, (2) terminals electrically connectable to the metal receptacles (3) a spring loaded displaceable peg longitudinally situated in between the metal prong receptacles and (4) a pair of resilient contacts connected to the displaceable peg and moveable therewith such that when the peg is depressed each resilient contact will electrically connect a metal prong receptacle with its corresponding terminal. The displaceable peg is locked in a forward position by a locking head at the forward end of such resilient contact extending into an aperture located in the adjacent receptacle wall. The locking head extends through the receptacle wall aperture into the prong slot and prevents the backward movement of the displaceable peg until the locking head has been forced out of both prong slots by means of an object, such as the prongs of a plug, being inserted therein. When the peg is in its forward locked position the resilient contact and prong receptacle walls are not electrically connected to their corresponding terminals. When the prongs of a plug are inserted into the prong slots defined by the receptacle walls, the prongs cause the locking heads to recede out of the prong slots. This action releases the displaceable peg which is contacted by the flat front insulated end of the plug and pushed backwardly into the socket housing. As the peg moves backwardly, the resilient contact, under stress, also moves with the locking head frictionally sliding along the receptacle walls and the rear end of the resilient contact coming into contact with the corresponding terminals thereby energizing the socket. When the plug is removed from the socket, the peg moves forwardly under spring pressure and the flexible contacts also move forwardly away from their respective terminals thereby opening the circuit and deenergizing the socket. At the end of the forward movement of the peg, the locking head snaps through the apertures in the receptacle walls locking the peg in position. The peg extends outwardly from the front surface of the socket housing so that it can be displaced backwardly when an electrical plug is inserted into the socket.

DRAWINGS

DETAILED DESCRIPTION OF THE INVENTION

Figure 1:
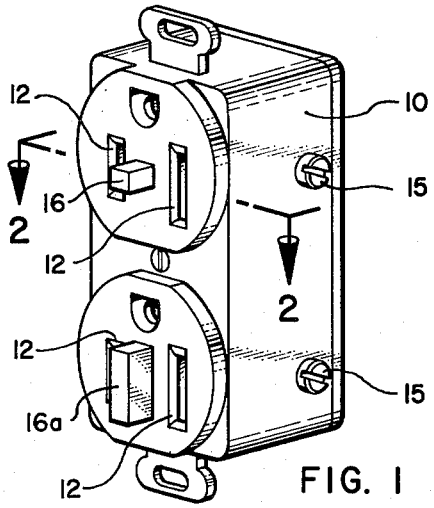
FIG. 1 is a perspective view of a safety socket in the form of a wall outlet showing the prong slots and the displaceable peg located between the prong slots in a forward position. Two different embodiments of the displaceable peg are shown.
Figure 6:
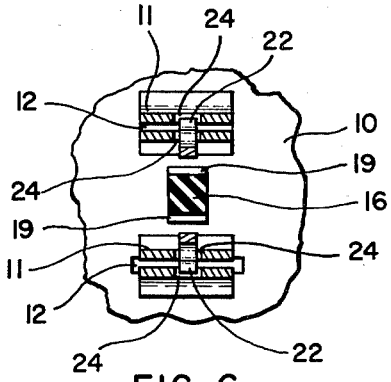
FIG. 6 is a partial enlarged sectional view taken along lines 6—6 of FIG. 2 showing the forward portion of the prong receptacles with the locking head of the contact engaged therein.

There is shown in FIGS. 1–3 and 6 a complete operative embodiment of the invention. While the invention may be utilized in any of the various forms into which an electrical plug can be inserted, it will be described herein in terms of a conventional wall outlet containing a double socket. However, the details of only one socket will be described with the exception of the displaceable peg. The various cooperative elements of the invention are contained in a non-conductive housing 10 made of a thermosetting resin or the like. Positioned in the housing in parallel relationahip and having forward open ends, are conductive metal prong receptacles 11 forming prong slots 12 into which prongs 13 of an electrical plug 14 may be inserted. Electrical terminals 14 are positioned at the rear of the housing in a spaced relationahip to receptacles 11. An electrical circuit within the socket cannot be completed until each receptacle 11 is electrically connected to its corresponding terminal 15.

The energizing of the socket is controlled by a safety mechanism involving a displaceable non-conductive peg 16 axially positioned in housing 10 between prong receptacles 11. The rear of peg 11 contains a cavity which is slidable about a post 17 protruding forwardly from the rear of housing 10. Spring 18 is positioned in the cavity between the forward closed end of the cavity and the end of the post 17. Peg 16 protrudes forwardly through an aperture in the face of socket housing 10. Peg 16 is stopped in its forward motion by a collar 19 or similar means, which abuts against the inner face of the socket housing 10 under tension from spring 18. Peg 16 is square or multi sided. Post 17 and the peg cavity may be similarly shaped thus preventing peg 16 from rotating within the housing. The length of peg 16 is critical only to the extent that it performs its proper functions as will be described.

Figure 2:
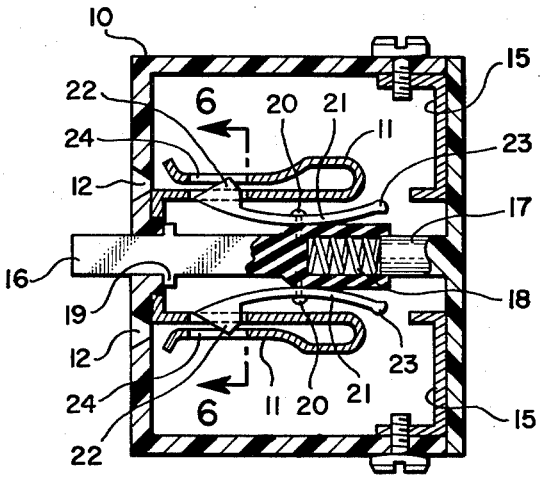
FIG. 2 is a top cross-sectional view of the safety socket taken along lines 2—2 of FIG. 1 showing one embodiment of the displaceable peg being locked in a forward position by means of the locking head of the resilient contact extending into apertures in the inside walls of the prong receptacles.
Figure 3:
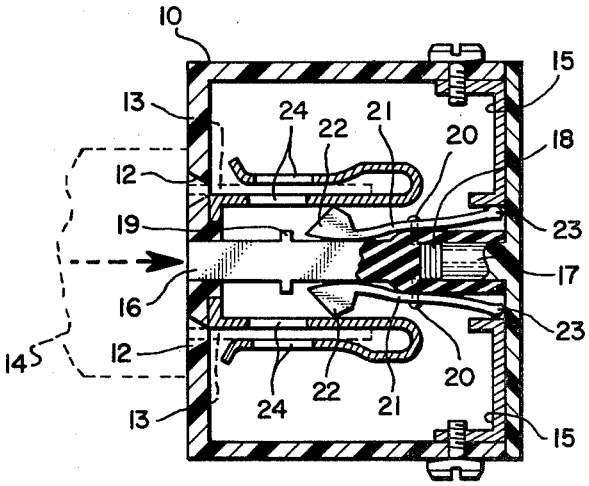
FIG. 3 is a top cross-sectional view as shown in FIG. 2 with an electrical plug, shown in phantom lines, being fully inserted therein activating the socket.

Mounted on opposite sides of peg 16 and attached thereto by pins 20 or other means is a pair of parallel flexible metal contacts 21. Contacts 21 are bowed or otherwised shaped such that when moved or flexed into any other position they will come under stress until allowed to return to their original position. Each flexible contact contains a locking head 22 and a tail portion 23. In the wall of each prong receptacle 11 which is adjacent to locking head 22. Aperture 24 may extend to both inner and outer walls of receptacle 11 or only in the wall adjacent the flexible contact, which in FIGS. 2 and 3 is the inner wall. The locking head 22, as shown in FIGS. 2 and 3, is shaped such that, with regards to prong slot 12, the head angles backwardly and inwardly to form a front face and then backwardly and outwardly for a shorter distance to form a back face and then inwardly at right angles to the receptacle walls to form a locking face. Contact 21 is curved such that locking head 22 will snap or extend into aperture 24 when in its natural or unflexed position, with the locking face abutting the receptacle wall at the rear of the aperture. When situated as described, displaceable peg 16 is locked in its forward position and is prevented from backward movement by locking head 22 of contact 21 and from forward movement by collar 19. Contact 21 is sized such that, when locking head 22 is inserted into aperture 24, tail portion 23 will be out of contact with its corresponding electrical terminal 15. The tail portion 23 of contact 21 and contact 15 are shaped such that when peg 16 is displaced backwardly flexible contact 21 will also move backwardly causing tail 23 to frictionally engage a portion of terminal 15 while at the same time keeping head 22 in contact with the corresponding prong receptacle 11. The tip of tail 23 is preferable rounded or otherwise contoured so that when the tail contacts the sidewall of terminal 15 the tail will flex and lside against the sidewall.

The peg 16 is maintained in axial alignment by means of the aperture in the face of the housing through which the peg extends and post 17. When the peg 16 is in its forward locked position, the rear portion of the peg cavity remains engaged over post 17. Post 17 further acts as a guide when peg 16 is rearwardly displaced.

With the various parts of the safety socket defined, its mode of operation is as follows. When the socket is in a deenergized or safe position, peg 16 is tensioned forward by means of spring 18. Peg 16 is locked in this position by the locking head 22 of flexible contact 21, the prong receptacle aperture 24 allowing the locking head 22 of either side of peg 16 to expand through aperture 24 into prong slots 12. Flexible contact 21 is moveable with peg 16 and when peg 16 is locked in its forward position, contact tail 23 of flexible contact 21 and its corresponding terminal 15 are separated thereby preventing the potential flow of electricity through the socket until the peg 16 is rearwardly displaced.

With the socket thus assembpled, it is extremely difficult for a small child to energize the socket. Even though a child may insert a wire, nail or similar object into each prong slot, the socket will still not be activated until peg 16 is depressed connecting flexible contact 21 with terminal 15. The manual dexterity required to do this is too advanced for most children. Objects must be inserted into both prong holes to retract the tops of the locking head 22 before peg 16 can be displaced rearwardly.

The socket can be easily energized with an electrical plug. The locking head 22 is so shaped and positioned in the prong receptacle that when the prongs 13 of a plug 14 contact the front face of locking head 22, the head will flex outwardly releasing the locking face from contact with the rear edge of aperture 24 in prong receptacle 11 thereby unlocking peg 16. The beveled front and rear faces of locking head 22 allow the head to flex completely out of aperture 24 as prongs 13 are moved deeper into prong receptacles 11. Peg 16 is unlocked by the time the face of plug 14 contacts it and is rearwardly displaced as prongs 13 are further inserted into the prong receptacles. The rearward movement of peg 16 also causes flexible contacts 21 to move rearwardly with locking heads 22 sliding, under stress, along the surfaces of prong receptacles 11 and also causes contact tails 23 to engage their corresponding electrical terminals 15 thus energizing the socket. On removal of plug 14, spring 18 forces peg 16 forward until collar 19 abuts the inner front surface of housing 10 thereby removing flexible contacts 21 from electrical contact with terminals 15 and allowing locking heads 22 to again be engaged in apertures 24 and locking peg 16 in its forward position.

Preferably the length of flexible contact 21 is such that the contact tail 23 will not engage terminals 15 until prong 13 are almost fully inserted into prong slots 12. Also, it is preferable that apertures 24 and locking head 22 be positioned such that the prongs 13 are inserted deeply enough into prong slots 12 before peg 16 is unlocked to prevent placement of a finger or other object between the prongs after the peg is unlocked.

Some accidents occur by placing a wire or similar object across both prongs of a plug which is partially inserted into a socket. Since the socket of this invention is not energized until the prongs are almost fully inserted into the prong slots such an accident is not likely. However, by sizing peg **16*a* as shown in FIG. 1 so that it extends above the top of above and below the top and bottom of the prong slots 12 it will not be possible to lay an object across the prongs of a plug when the socket is energized. Thus peg 16*a*** may be oblong in shape as illustrated or any other shape that serves the same function.

Figure 4:
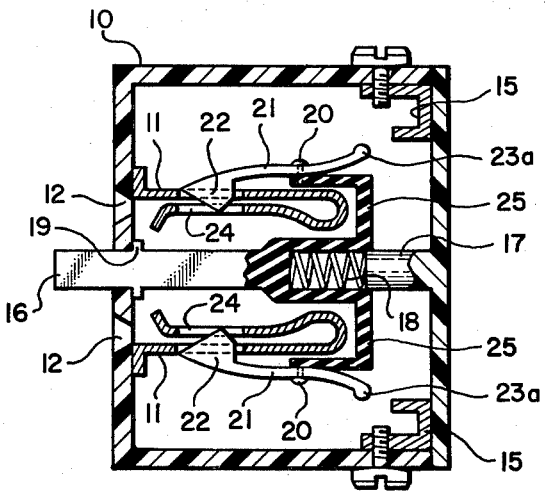
FIG. 4 is a top cross-sectional view of the safety socket taken along lines 2—2 of FIG. 2 showing a second embodiment of the displaceable peg being locked in a forward position wherein the resilient contact is adjacent the outside wall of each receptacle.
Figure 5:
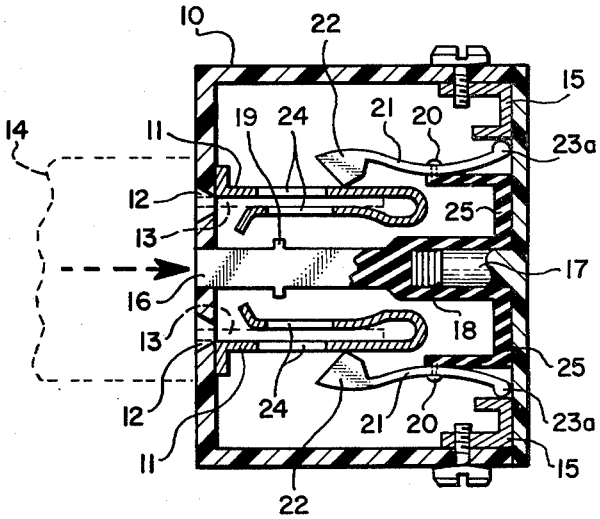
FIG. 5 is a top cross-sectional view as shown in FIG. 4 with an electrical plug, shown in phantom lines, being fully inserted therein activating the socket.

FIGS. 4 and 5 illustrate a second embodiment of the invention wherein flexible contacts 21 are attached to peg 16 by means of extension arms 25 which extend behind and around prong receptacles, and are adjacent the outer walls of the prong receptacles. Contact tail 23*a* is curved oppositely to locking head 22 and receptacles 11 are shaped such that the outer walls must contain apertures 24 and present a flat contact surface which locking head 22 may slide along as peg 16 is rearwardly displaced. Terminals 15 are sized and positioned such that contact tail 23*a* will be engaged therewith when peg 16 is displaced to energize the socket. Otherwise the function is exactly the same as illustrated in FIGS. 2 and 3.

While the invention has been described in its preferred embodiment, various modifications and changes may be made without departing from the scope of the invention which is to be limited only by the appended claims. For example, the same safety features can be readily applied to a 220 volt socket by one having ordinary skill in the art. Also it is possible to form a prong receptacle having a single conductive wall instead of an inner and outer wall as described herein.

We claim:

1. A safety socket assembly comprising a non-conductive housing containing;

(a) a pair of parallel conductive prong receptacles adapted to receive the prongs of an electrical plug each of said receptacles containing an aperture in a wall therein adapted to receive locking means, (b) a pair of corresponding electrical terminals spaced from, but electrically connectable to said prong receptacles, (c) a rearwardly displacable, non-conductive, non-rotatable peg axially aligned between said prong receptacles said peg extending forwardly from the front of said housing when the peg is in its forward position, (d) alignment means to keep said peg in axial alignment between said prong receptacles, (e) spring means interspersed between said peg and the rear of said housing exerting a forward force on said peg, (f) a pair of flexible, conductive contacts each contact being attached to opposite sides of said peg, and located adjacent a prong receptacle, each contact having a forward locking head and a rear contact tail, said locking head being in alignment with and tensioned to snap into a prong receptacle aperture in a locking relationship when the peg is in its forward position, said contacts being sized and shaped such that when said locking heads are located in said prong receptacle wall apertures with the peg in its forward position the tails of said contacts are not in engagement with the corresponding electrical terminal, but when the locking heads are flexed out of the prong receptacle wall apertures and the peg rearwardly displaced compressing said spring means, the locking heads of said flexible contacts will be electrically engaged with the walls of said prong receptacles and the tails of said flexible contacts will be electrically engaged with the corresponding terminals.

2. A safety socket assembly according to claim 1 wherein the flexible conductive contacts are located between the peg and the prong receptacles.

3. A safety socket assembly according to claim 1 wherein the peg has a pair of extension arms which extend outwardly from the base thereof behind the prong receptacles and then forwardly on the outerside of said receptacles and wherein said flexible conductive contacts are attached to the forwardly extending portion of said extension arms and adjacent to the outer side of said receptacles, with the tail portion of said contacts being on the outer side of the forwardly extending portion of said extension arms.

4. A safety socket assembly according to claim 1 wherein the locking heads of the flexible contacts are shaped to have a slanting front face and an oppositely slanting rear face which angles to become a flush locking face adapted to abut the wall of the prong receptacle at the rear of the aperture into which the locking head extends thereby locking the peg in a forward position and preventing rearward movement of said peg.

5. A safety socket assembly according to claim 1 wherein the displaceable peg is dimensioned between the prong receptacles such that the top of the peg extends above the top of prong slots formed by the prong receptacles.

6. A safety socket assembly according to claim 1 wherein the alignment means consists of a cavity in the rear portion of the peg having a closed forward end and an open back end and a forwardly protruding post at the rear of the housing extending into said cavity in a slidable relationship and an aperture in the front of said housing in alignment with said post from which the forward position of said peg extends.

7. A safety socket assembly according to claim 6 wherein the spring means is located in the peg cavity between the closed forward end and the forwardly protruding post.

8. A safety socket assembly according to claim 7 wherein the peg contains means to prevent forward movement of the peg past the position where the locking heads of the flexible contact come into alignment with the apertures in the walls of the prong receptacles.

9. A safety socket assembly according to claim 1 wherein the flexible contact, displaceable peg and prong receptacles are positioned such that when the prongs of an electrical plug are inserted into the prong receptacles with the peg locked in its forward position the prongs will first make contact with the locking head of the flexible contact causing the locking head to flex out of the aperture in the prong receptacle wall unlocking the peg followed by the end of the plug contacting the forward end of the peg as the prongs are inserted more deeply into the prong receptacles culminating with the peg being rearwardly displaced such that the forward end of the peg becomes flush with the front surface of the housing with the flexible contact being engaged with both the prong receptacles and corresponding electrical terminals when the prongs are fully inserted in the prong receptacles.

10. A safety socket according to claim 9 wherein the electrical terminals and flexible contacts are positioned such that the flexible contacts become engaged with both the prong receptacles and their corresponding electrical terminal only during the insertion of the latter portion of the prongs of an electrical plug into the prong receptacles.

* * * * *